US011465423B2

(12) United States Patent
Schiestl

(10) Patent No.: US 11,465,423 B2
(45) Date of Patent: Oct. 11, 2022

(54) APPARATUS AND METHOD FOR PRINTING PRINT OBJECTS WITH INDEPENDENTLY MOVABLE PRINTHEADS

(71) Applicant: Angelo Schiestl, Langkampfen (AT)

(72) Inventor: Angelo Schiestl, Langkampfen (AT)

( * ) Notice: Subject to any disclaimer, the term of this patent is extended or adjusted under 35 U.S.C. 154(b) by 226 days.

(21) Appl. No.: 16/065,687

(22) PCT Filed: Dec. 22, 2016

(86) PCT No.: PCT/EP2016/082306
§ 371 (c)(1),
(2) Date: Oct. 1, 2018

(87) PCT Pub. No.: WO2017/109036
PCT Pub. Date: Jun. 29, 2017

(65) Prior Publication Data

US 2019/0016152 A1 Jan. 17, 2019

(30) Foreign Application Priority Data

Dec. 23, 2015 (EP) ..... 15202440

(51) Int. Cl.
*B41J 3/407* (2006.01)
*B41J 15/04* (2006.01)
(Continued)

(52) U.S. Cl.
CPC ..... *B41J 3/28* (2013.01); *B41J 3/4078* (2013.01); *B41J 3/543* (2013.01); *B41J 15/048* (2013.01); *D06P 5/30* (2013.01)

(58) Field of Classification Search
None
See application file for complete search history.

(56) References Cited

U.S. PATENT DOCUMENTS 3,476,231 A * 11/1969 Bower ..... B23P 19/001 198/345.2
4,348,125 A * 9/1982 Fujiwara ..... B41J 15/04 226/196.1
(Continued)

FOREIGN PATENT DOCUMENTS

CN 201941271 U 8/2011
WO WO-2006060644 A2 * 6/2006 ..... B41J 3/543

OTHER PUBLICATIONS

International Search Report issued in PCT/EP2016/082306; dated Apr. 13, 2017.
(Continued)

*Primary Examiner* — Jill E Culler
(74) *Attorney, Agent, or Firm* — Studebaker & Brackett PC

(57) ABSTRACT

The invention relates to a printing apparatus for printing print objects, comprising a machine base body which has a width side and a longitudinal side and is designed to accommodate at least one print object, a guide device which is arranged above the machine base body and extends over the print object over the width of the machine base body, and a printing device which is designed to print the print object and is moveably arranged on the guide device over the width of the machine base body. The printing device comprises at least one first print head unit and a second print head unit, which can be independently moved relative to each other over the width of the machine base body on the guide device, wherein each print head unit has at least one print head which is designed to print the print object with at least one printing ink. In addition, the invention relates to a print method for printing textile surfaces, in particular with the apparatus, according to the invention, in which at least one print object is held on a machine base body and a printing device is delivered to the at least one print object. The first
(Continued)

print head unit and at least one second print head unit of the printing device are independently moved over the width of the holding base body relative to each other along a guide device and print the at least one print object with a printed image.

5 Claims, 1 Drawing Sheet

(51) Int. Cl.

| | |
|---|---|
| ***B41J 3/28*** | (2006.01) |
| ***B41J 3/54*** | (2006.01) |
| ***D06P 5/30*** | (2006.01) |

(56) References Cited

U.S. PATENT DOCUMENTS 4,739,415 A * 4/1988 Toyono ..... B41J 3/28 347/12
5,810,487 A * 9/1998 Kano ..... B41J 3/28 400/83
6,367,910 B1 * 4/2002 Sette ..... B41J 25/001 347/37
2003/0137550 A1 * 7/2003 Baiges ..... B41J 3/543 347/20
2005/0179708 A1 * 8/2005 Ben-Zur ..... B41J 3/28 347/2
2006/0119629 A1 * 6/2006 An ..... B41J 3/28 347/5
2009/0101064 A1 * 4/2009 Naka ..... G02F 1/1303 118/313
2009/0102869 A1 4/2009 Niimi et al.
2009/0120249 A1 5/2009 Gauss et al.
2009/0191341 A1 * 7/2009 Kojima ..... B41J 3/543 427/256
2009/0267975 A1 10/2009 White et al.
2010/0066779 A1 * 3/2010 Gothait ..... B41J 2/16588 347/14
2013/0307915 A1 * 11/2013 Persons ..... B41J 11/06 347/104

OTHER PUBLICATIONS

An Office Action mailed by China National Intellectual Property Administration dated Nov. 1, 2019, which corresponds to Chinese Patent Application No. 201680082517.7 and is related to U.S. Appl. No. 16/065,687; with English language translation.

An Office Action mailed by the Indian Patent Office dated Oct. 14, 2020, which corresponds to Indian Patent Application No. 201837026955 and is related to U.S. Appl. No. 16/065,687.

* cited by examiner

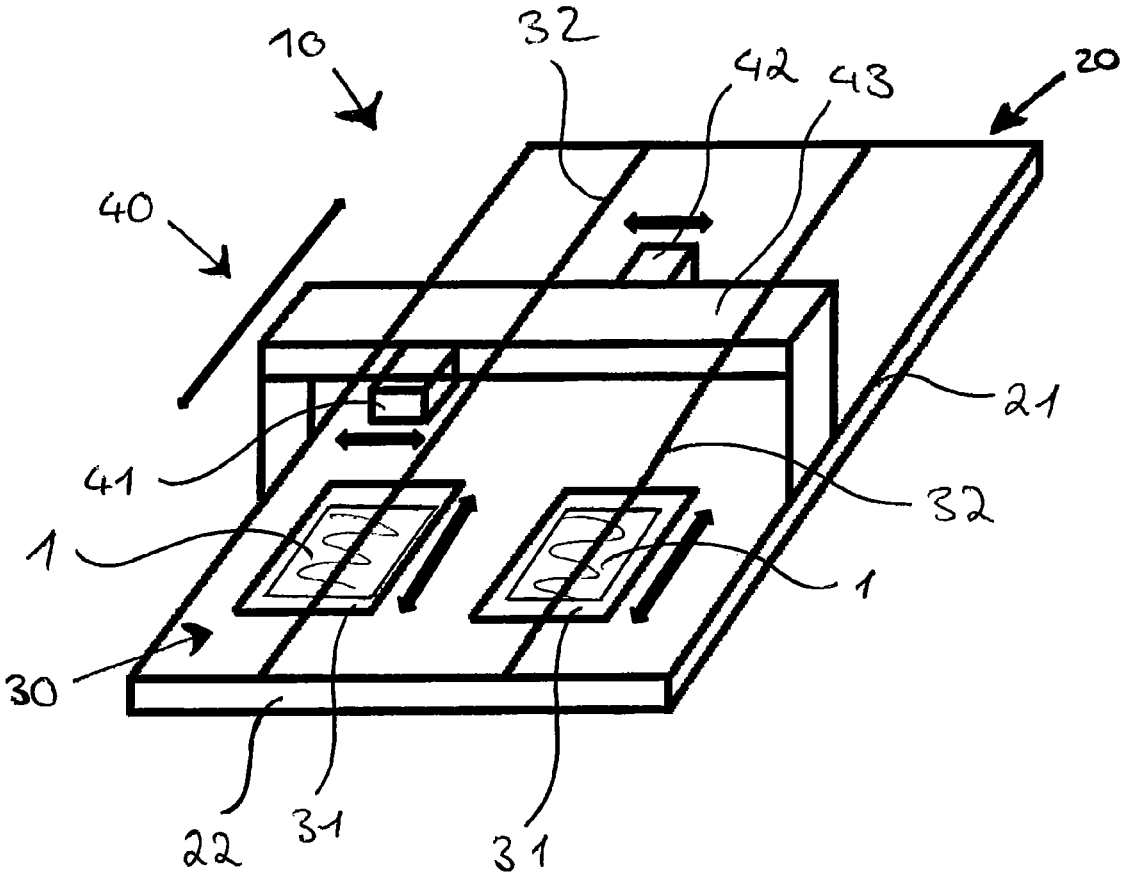
10
32
42
43
20
40
21
41
32
1
1
30
22
31
31

APPARATUS AND METHOD FOR PRINTING PRINT OBJECTS WITH INDEPENDENTLY MOVABLE PRINTHEADS

The invention relates to a printing device for printing on print workpieces.

One of the limiting factors on throughput in print technology is the speed at which a printed image can be applied to the print workpiece to be printed on. In wet printing technology in particular, hence when viscous printing ink is being used, movable printing means are used which can be brought to an area of a print workpiece to be printed on. The speed at which a printing means of this kind is able to change its position between application points in an area being printed upon is subject to mechanical limitations. In addition, an insufficient time interval between a printing means position changing and the subsequently applying a droplet of a fluid printing ink to the printing workpiece can result in centrifugal forces acting on the printing ink droplet during its application. This can have a detrimental effect on the geometric shape of the printing ink droplet. As a result, an insufficient time interval between the reposition of the printing unit and the printing ink droplet being applied by the printing unit can cause a blurring in the printed image. For reasons of the efficiency of a printing means being used as well as for economic considerations, there is a persisting need for a device or a method making it possible to overcome the aforementioned and other limitations on print technology and to provide an efficient option for printing.

A generic printing device is known, for example, from CN 201941271 U. This relates to a printer which prints by means of a digital inkjet printhead on multiple textiles arranged side by side. The printing device comprises two separate holders for the textiles to be printed on. The textiles can be printed on by means of moving the printhead along a guide track.

US 2009/0267975 A1 teaches a method and a device for printing on display panels. Provided for this purpose is a printing device in the form of a crossbar being arranged above a printer bed and featuring printheads that are arranged above the surface to be printed on. The printheads are designed to be moved independently of one another along the printing device.

US 2009/0120249 A1 discloses a device for working on wood panels. The wood panels are both cut to size and printed on by means of the device. For this purpose, a first printhead is arranged on at least one portal guide and on the opposite side of the portal guide a second printhead is arranged, with the printheads being arranged along the portal guide able to move independently from one another. The portal guide is provided movable in a direction X with respect to a provided conveyor belt.

The object of the invention is to provide a printing device which enables efficient printing on a print workpiece. The object of the invention is furthermore to provide a method for printing on print workpieces.

The printing device according to the invention for printing on print workpieces is characterized in that the printing device features at least one printhead unit and one second printhead unit, which printheads are able to move on the guiding means across the width of the machine base body independently of and in relation to one another, and that each printhead unit features at least one printhead, which is designed to print at least one color of print ink on the print workpiece.

Furthermore, the method according to the invention for printing on print workpieces is characterized in that a first printhead unit and at least one second printhead unit of the printing device are moved along a guiding means across the width of the supporting main body independently of and in relation to one another, and that an image is printed on at least one print workpiece.

A fundamental idea of the invention consists of providing a printing device having a multipart printing means, whereby the single parts of the printing means are able to be brought individually or rather independently of one another to at least one printing area on the print workpiece or print workpieces.

A fundamental idea of the invention furthermore consists of providing a method for printing on a print workpiece in which multiple parts of a printing means are brought individually or rather independently of one another to the print workpiece or print workpieces to be printed on.

In this context, the term "individually brought to" can in particular mean that parts of the printing means can be individually controlled in order to assume a position, for example opposite to the machine base body of the printing device, specifically on the guiding means. In this context, the term "independently of one another" can in particular mean that the position or rather the movement of part of the printing means does not act as a limitation on choosing the position of another part of the printing means or the range of the motion processes or motion clearance thereof, specifically along the guiding means.

The print workpiece can be any desired object which is to be printed on. Preferably, at least in one printing area the print workpiece features a flat surface, in particular oriented parallel to the machine base body. The print workpiece particularly preferably relates to textile materials.

According to an embodiment of the invention, it is advantageous for the machine base body to feature at least one translating means, upon which the accommodated print workpiece is arranged and which is designed to change the position of the at least one print workpiece with respect to the machine base body. In principle, the machine base body can have any shape which enables the accommodation and support of the individual means of the printing device. It is particularly advantageous for the machine base body to have a rectangular shape. The translating means can be designed to accommodate basically at least one print workpiece, in which case the position of the translating means on the machine structural body and, consequently, the position of the at least one print workpiece on the printing device, in particular on the machine base body, can be variable.

As a result, the at least one printhead unit is essentially able to be brought to a printing area on the print workpiece by means of moving and/or positioning the printhead unit to an area above the machine base body, or by means of moving and/or positioning the at least one print workpiece on the machine base body, hence on the translating means.

Similarly, a combination of the two is conceivable, in which case the print workpiece is movable by means of the translating means and the at least one printhead unit is movable, in particular on the guiding means, in order to bring the at least one printhead unit to an area to be printed on the print workpiece, for example, by way of the proportionate relative displacement of both.

Accordingly, the relative displacement of the print workpiece and the printhead unit or printhead units can be provided by means of both exclusively and proportionally moving of at least one of the translating means and/or at least the printhead unit(s), hence one or multiple printhead units. If, in particular, the relative displacement of the translating means or rather of the print workpiece and the printing device in relation to one another takes place by means of more than one of the two means, the distance between two areas to be printed on the at least one print workpiece can be overcome with an increased velocity. This velocity can be greater than the velocity at which one individual of the means move without the velocity at which the individual means move having to change for this purpose. As a result, the print workpiece or rather the printhead unit(s) can be delivered in opposing directions and/or reciprocally.

One advantageous embodiment of the invention consists of the translating means featuring at least one carriage, upon which the at least one print workpiece is movably supported in a direction approximately parallel to the longitudinal side and/or the lateral side of the machine base body. The carriage can be brought to any desired area(s) on the machine base body, but at least to those relevant to the printing procedure. Said areas on the machine base body relevant to the printing procedure are at least those to which the printhead unit(s) can be brought in order to print on at least one area to be printed of the print workpiece, on the translating unit. In principle, the print workpiece can be secured to the carriage in a way that prevents displacement or slippage on the carriage, which can contribute to enabling the printing means or rather the printheads of the printhead units to be positioned quite precisely with respect to the print workpiece to be printed on.

The translating means preferably features a conveyor belt which is designed to convey the at least one print workpiece on the machine base body at least in one direction along the longitudinal side of the machine base body. The translating means can be used both for printing in batches and for an endless printing process. The batch-wise operation can in particular be distinguished by the performance of a discontinuous operation of the printing device, during which the translating means can be moved into an initial position in order to replace a print workpiece that has already been printed on with a print workpiece that will be printed on. In this case, a printing in particular between the removing of the print workpiece that has already been printed on from the translating unit and securing of the print workpiece that will be printed on at the translating unit can be interrupted. A continuous operation of the printing device can be characterized in particular by print workpieces that will be printed on being brought, for example, at either a constant or a variable speed to a first area of the printing device, while in at least one second area of the printing device print workpiece that have been printed on can be continuously removed without interrupting or hindering a printing process or the flow of print workpieces before, within, or following the printing device. In this context, the printing device can in particular be one provided for a continuous process such as during the production of a print-ready workpiece is used, for example, with a tailoring device used to tailor clothing.

A particularly preferential embodiment of the invention consists of the guiding means being arranged to be approximately parallel to the lateral side of the machine base body. Upon the guiding means, the print means can be brought to areas on the machine base body which are relevant to the printing process. According to the inkjet process in particular, a printed image in a printing area can be divided into printing lines that are parallel to one another, the totality of which form the printed image. The guiding means on the machine base body can in particular be oriented according to the printing lines of the printed image to be printed on the print workpiece according to, for example, the inkjet process, specifically in a direction parallel to the printing lines. Consequently, by means of moving the printhead units respectively as necessary along the guiding means, a printing line of the image to be printed on the workpiece can be printed.

According to an embodiment of the inventive device, it is particularly advantageous for the guiding means to be designed as a portal guide having a crossbar which extends in a lateral direction, and for the first printhead unit to be movably supported on a front side of the crossbar and the second printhead unit is movably supported on a rear side of the crossbar. The guiding means, in particular the portal guide, can be movably supported with respect to the machine base body, for example along the longitudinal side. This approach enables at least one of the printhead units to be brought along any desired lateral direction, along the short side of the machine base body, by means of moving the printhead unit along the guiding means, in particular the portal guide. Bringing the printhead units in a lengthwise direction, thus along the longitudinal side of the machine base body, to an area of the print workpiece that will be printed on can be made possible by means of moving the guiding means, in particular the portal guide. The front side, hence the front long side of the guiding means, in particular the crossbar of the portal guide, can be faced to the side from which the print workpiece that will be printed on is initially fed to the printing device. The rear side of the guiding means, in particular the rear side of the crossbar of the portal guide, can be a side at the guiding device running along the lateral side which is opposite the front side and which, in particular, is situated opposite the side of the printing device from which initially print workpiece can be fed.

According to a particularly preferable embodiment of the invention, it is advantageous for each of the printhead units of the printing means to be designed for the parallel printing of a plurality of adjacent print workpieces that have been provided. In principle, the translating means can also be designed in a multipart manner and/or in order to accommodate multiple print workpieces. It can also be made possible to provide or orient multiple print workpieces adjacent to one another in a lateral and/or longitudinal direction on the machine base body. The guiding means can as a result be positioned above multiple print workpieces at the same time. By means of moving the printhead units along the guiding means, it can be made possible for a plurality of print workpieces located in the area of the guiding means to be reached for the purpose of printing at least one printing line or at least one partial printing, without moving the guiding means on the machine base body. As a result, one or various print rows arranged on a printing line or partial images for several print workpieces to be printed on can be accomplished using already one (line) movement of a printhead unit along the guiding means without needing to move the guiding means in this process. The printing areas of the multiple print workpieces can in this way be provided with a consistent printed image. Similarly, print workpieces having individual printed images can be provided with individual printed images line-by-line collectively, or on a selection of print workpieces in the aforementioned manner.

In a printing process according to the inkjet printing process in particular, one printing line of an individual image or of multiple printed images arranged adjacent to one another which are to be provided on the same or various print workpieces can in principle consist of a definite number of printed dots. The printed image can likewise consist of a definite number of individual printing lines, which can in turn consist of printed dots. In printing on the single or the multiple print workpieces, the first printhead unit and the at least second printhead unit can interact insofar as that each for itself taken an individual line of the printed image along the guiding means prints on the at least one print workpiece, as a result of which the number of image printing lines to be printed per printed image or per printhead unit can be reduced. This can lead to a speeding up the printing process until completing the printed image or rather a print job with multiple printed images on one or multiple print workpieces. In printing a single or multiple printed images on a single or on multiple print workpieces, the printhead units can also interact insofar as that printing units will print a definite number of the printed dots to be printed per line, which is lower than the total number of printed dots to be printed per printing line, in which case the at least second printhead unit prints the dots on each line which are not printed by the first printhead unit.

A particularly preferential embodiment of the device according to the invention consists of the printhead units of the printhead means being designed to print an image on the least one print workpiece both collectively and independently of one another. Being able to move freely along the guiding means, the multiple printhead units can be brought individually or rather independently to individual, adjacently arranged print workpieces in order to print at least one printing line or one partial image on each of them. In this context, the number of printhead units can be in operation in particular can which corresponds to the number of print workpieces to be printed on in parallel. Additional print units provided on the printing device can assist by further printing on the print workpieces. If the number of print workpieces to be printed on in parallel is equivalent to the number of printhead units provided, each of them can be provided to print on an individual print workpiece. Similarly, the printing means can work entirely or partially together to print one or multiple printed images collectively on at least one print workpiece.

According to an embodiment of the inventive method, it is preferable for the first printhead unit to be moved along a first longitudinal side of the guiding means and the at least second printing unit to be moved along a second longitudinal side of the guiding means. The arrangement of printhead units on different sides of the guiding means, in particular the crossbar of the portal guide, allows the printhead units to move along the guiding means unhindered and independently of one another. Particularly, each of the printhead units provided on the guiding means can be brought to the printing-relevant points along the guiding means, in particular along the crossbar of the portal guide above the machine base body, without in this process having to account for the position of another printhead unit or being hindered due to the position of the other printhead unit.

According to an embodiment of the inventive method, it is particularly preferable for the printhead units to print the printing image on the print workpiece collectively or independently of one another according to need.

The invention will be explained hereinafter in greater detail with the aid of the schematic drawing appended. In the drawing shows:

FIG. 1: a schematic representation of a preferential embodiment of the printing device according to the invention.

FIG. 1 illustrates a perspective view of a printing device 10. The printing device 10 features a machine base body 20 having a longitudinal side 21 and a lateral side 22. The longitudinal side and lateral side 21/22 can in particular provided to be approximately rectangular with respect to one another. Arranged on the machine base body 20 can be a translating device 30, which can feature one or multiple carriages 31. At least one conveyor belt can be provided as part of the translating means 30 instead of the carriage or carriages. The at least one carriage 31 can be movably supported on the machine base body 20 in a longitudinal direction along the longitudinal side 21 by way of a conveying means 32. In this context, related to the carriage in particular can be a carriage guide, in particular one having a guide chain or a ribbed belt for moving or displacing the translating means 30. A guiding means 40, which can in particular be configured as a portal guide, can be arranged above the machine base body 20. The guiding means, in particular the portal guide, can feature a crossbar 43, on the front side of which a first printhead means 41 can be arranged and a second printhead means 42 can be arranged on a rear side of the crossbar 43. The number of printhead units on the guiding means 40 can be adjusted according to need, in which case even more than two printhead units can be provided. The printhead units can collectively form the printing means. The first printhead unit 41 and the second printhead unit 42 in particular can be movably supported along their respective sides of the crossbar 43 parallel to the lateral side 22 of the machine base body 20. As a result, the printhead units can be brought individually and independently in a lateral direction on the guiding means 40 to printing-relevant areas on the machine base body. "Printing-relevant" can in particular mean those areas on the surface of the machine base body upon which a print ink droplet or a partial image is intended to be printed on a print workpiece 1 located under the printing means.

If, for example, a single print workpiece 1 is provided on the translating means 30 of the printing device 10, the separate printhead units, in particular the first printhead unit 41 and the second printhead unit 42, can collectively create the printed image on the print workpiece 1 by printing line-by-line or by separately printing the individual image dots. It is also possible for each printhead unit to assign a separate printing area or printed image which printhead unit prints on then a printed image.

If more than one print workpiece is provided on the translating unit 30, the printhead units can both print on the print workpieces separately, hence a first printhead unit for the first print workpiece and the additional printhead units each for an additional print workpiece. The printhead units can also print collectively on the print workpieces, in which case the print workpieces to be printed on can be arranged adjacent to one another parallel to the lateral side 22 and in particular parallel to the guiding means 40, and the printheads can be moved above the print workpieces on the guiding means 40 in order to print on said workpieces. Printed images can be formed in this way on the individual print workpieces, for example collectively by means of the printhead units available on the printing means, in which case a printing line can be applied to the one or the multiple print workpieces by means of a (line) movement of a printhead unit along the guiding means.

In order to speed up the process of bringing the printhead unit(s) between various printing areas and/or partial image areas on the machine base body 20, the guiding means 30, in particular the portal guide on the machine base body 20, can be movably supported, for example along the longitudinal side 21 of the machine base body 20. As a result, a print workpiece 1 can, for example, be moved from a first position on a front end of the machine base body (as illustrated in FIG. 1) to a second position, for example on the opposite end of the machine base body 20, and, during said movement— but also while the print workpiece is resting on a arbitrary point on the surface of the machine base body—it can be reached by way of the guiding means and printed on with printing ink by way of the printing means. Thus, by way of moving the guiding means, the position of the printing means or rather the printhead means can be changed, in a direction longitudinal to the machine base body, with respect to the machine base body, the translating means, or the at least one print workpiece.

The invention claimed is:

1. A printing device for printing on print workpieces comprising textile surfaces, comprising:

a machine base body having a lateral side and a longitudinal side, for accommodating at least one print workpiece, a guiding means above the machine base body and extending across the print workpiece and across the width of the machine base body, a printing means for printing on the print workpiece and movably arranged on the guiding means, wherein the printing means has at least one first printhead unit and one second printhead unit, which are able to move on the guiding means independently of and in relation to one another, wherein each printhead unit has at least one printhead for printing at least one color of a print ink on the print workpiece, wherein the machine base body has at least one first translating means upon which a first print workpiece is arranged, for changing the position of the first print workpiece with respect to the machine base body, wherein the machine base body has at least one second translating means upon which a second print workpiece is arranged, for changing the position of the second print workpiece with respect to the machine base body, wherein the first print workpiece and the second print workpiece are movable independently of one another beneath the guiding means with the at least two printhead units in a longitudinal direction, wherein the at least two printhead units are movable along separate guide paths on the guiding means, wherein the first printhead unit is movably supported on a front side of a crossbar and the second printhead unit is movably supported on a rear side of the crossbar, wherein the guiding means is a portal guide having the crossbar which extends in a lateral direction, and the portal guide is movably supported with respect to the machine base body, wherein the portal guide is for moving each of the printhead units of the printing means individually and independently along the lateral side and the longitudinal side of the machine base body to any part of any printing-relevant area on a surface of the machine base body upon which print ink is intended to be printed on the at least one print workpiece, wherein each of the printhead units of the printing means is for the parallel printing of a plurality of adjacent print workpieces, wherein the number of printhead units in operation corresponds to the number of print workpieces to be printed on in parallel, wherein the printhead units of the printing means are for printing an image on the least one print workpiece both collectively and independently of one another, and wherein the printing device is configured to be controlled to simultaneously move at least one of the first and second translating means and the first printhead unit, second printhead unit, and portal guide relative to each other such that the first and second printhead units are each moved between any two respective parts of the printing-relevant areas at a velocity greater than a velocity at which the first and second printhead units could be moved between the any two respective parts of the printing-relevant areas by moving only the first printhead unit, second printhead unit, and portal guide.

2. The printing device for printing on textile surfaces according to claim 1, wherein the translating means has a conveyor belt for conveying the at least one print workpiece on the machine base body at least in a direction along the longitudinal side of the machine base body.

3. The printing device for printing on textile surfaces according to claim 1, wherein the guiding means approximately parallel to the lateral side of the machine base body.

4. A printing method for printing on print workpieces using a printing device according to claim 1, comprising printing the printed image on the print workpiece using the printhead units collectively.

5. The printing method for printing on textile surfaces according to claim 4, wherein the first printhead unit is movable along a first longitudinal side of the guiding means, and the at least second printhead unit is movable along a second longitudinal side of the guiding means.

* * * * *